US005271965A

United States Patent [19]

Browning

[11] Patent Number: 5,271,965

[45] Date of Patent: Dec. 21, 1993

[54] THERMAL SPRAY METHOD UTILIZING IN-TRANSIT POWDER PARTICLE TEMPERATURES BELOW THEIR MELTING POINT

[76] Inventor: James A. Browning, c/o Browning Companies, P.O. Box A, May St., Enfield, N.H. 03748

[21] Appl. No.: 740,788

[22] Filed: Aug. 6, 1991

Related U.S. Application Data

[63] Continuation-in-part of Ser. No. 641,958, Jan. 16, 1991, Pat. No. 5,120,582.

[51] Int. Cl.[5] ..... B05D 1/08

[52] U.S. Cl. ..... 427/446; 427/450; 427/456

[58] Field of Search ..... 239/79, 85

[56] References Cited

U.S. PATENT DOCUMENTS

| | | | |
|---|---|---|---|
| 2,861,900 | 11/1958 | Smith et al. | 427/423 |
| 3,246,114 | 4/1966 | Matvay . | |
| 3,440,079 | 4/1969 | Jensen | 427/423 |
| 4,256,779 | 3/1981 | Sokol et al. | 427/446 |
| 4,343,605 | 8/1982 | Browning | 431/8 |
| 4,370,538 | 1/1983 | Browning | 239/83 |
| 4,416,421 | 11/1983 | Browning | 239/83 |
| 4,568,019 | 2/1986 | Browning | 239/83 |
| 4,836,447 | 6/1989 | Browning | 239/85 |
| 4,841,114 | 6/1989 | Browning | 219/121.47 |
| 4,869,936 | 10/1989 | Moskowitz et al. | 239/85 |
| 4,916,273 | 4/1990 | Browning | 219/76.16 |

*Primary Examiner*—Michael Lusignan
*Assistant Examiner*—Katherine A. Bareford
*Attorney, Agent, or Firm*—Sughrue, Mion, Zinn, Macpeak & Seas

[57] ABSTRACT

A method of operation of a plasma torch, an internal burner or the like to produce a hot gas jet stream directed toward a workpiece to be coated by operating the plasma torch or internal burner at high pressure while feeding a powdered material to the stream to be heated by the stream and projected at high velocity onto a workpiece surface. The improvement resides in expansion of the hot gas prior to feeding of the particles into the jet stream thereby limiting the heating of the powdered material by the jet stream to that only sufficient to raise the temperature of the particles of the powdered material to a temperature lower than the melting point of the material, and maintaining the in-transit temperature of the particles to the workpiece below that melting point, while providing a sufficient velocity to the particles striking the workpiece to achieve an impact energy transformation into heat to raise the temperature of the particles to fusion temperature capable of fusing the material onto the workpiece surface as a dense coating.

12 Claims, 1 Drawing Sheet

THERMAL SPRAY METHOD UTILIZING IN-TRANSIT POWDER PARTICLE TEMPERATURES BELOW THEIR MELTING POINT

This application is a continuation-in-part of application Ser. No. 07/641,958, filed Jan. 16, 1991, now U.S. Pat. No. 5,120,582, and entitled "MAXIMUM COMBUSTION ENERGY CONVERSION AIR FUEL INTERNAL BURNER".

FIELD OF THE INVENTION

The present invention is directed to high temperature, high velocity particle deposition on a substrate surface as from an internal burner or the like which may make use of regenerative air cooling together with a thermal insulation shield to maximize the useful energy release from an essentially stoichiometric flow of fuel to an air-fuel internal spraying applications, and more particularly to a thermal spray method in which the in-transit temperature of the powder particles is below the melting point, and wherein additional heat provides fusing of the particles by conversion of kinetic energy of the high velocity particles to heat upon impact against the workpiece surface.

BACKGROUND OF THE INVENTION

In the past, the HVOF (hypersonic velocity oxy-fuel) continuous spraying of higher melting point powdered materials such as tungsten carbide (in a cobalt matrix) has required the use of oxidizers of much higher oxygen content than that contained in air. for example, my earlier U.S. Pat. Nos. 4,416,421; 4,634,611; and 4,836,447 in particular, show forms of flame spray devices described as primarily oxy-fuel burners. Air may be one component of the oxidizer flow, but in each case the intensity of the flame jet relies on oxygen percentages greater than that contained in ordinary compressed air. The use of air to cool heated burner parts with this air subsequently entering and supporting the combustion process (regenerative cooling) was not feasible.

In place of "regenerative cooling", where the coolant becomes the oxidizing reactant, these prior flame spray devices rely on forced water cooling which severely limits the peak temperatures and jet velocities theoretically attainable. As an example, using a commercially available HVOF flame spray unit of the type discussed in U.S. Pat. No. 4,416,421, a simple heat balance shows that approximately 30% of heat released during the combustion process is carried away by the cooling water. Assuming a combustion peak flame temperature of 4,700 degrees Fahrenheit for a pure oxygen-propane mixture burning at a chamber pressure of 60 psig, if flame temperature was linearly related to heat content, then the 70% availability of the useful heat achieves a maximum flame temperature of only 3,150 degrees Fahrenheit. Of course, dissociation effects which limit the peak achievable temperature to 4,700 degrees F. release heat upon cooling. Thus, an actual combustion temperature of around 3,600 degrees F. is estimated.

Examining the combustion of compressed air and propane under conditions of essentially zero heat loss, the peak theoretical combustion temperature is about 3,400 degrees F. This is only 200 degrees F. less than that of the pure oxygen burner described above.

To now, in thermal spraying, it has become the practice to use the highest available temperature heat sources to spray metal powders to form a coating on a workpiece surface. It is believed that over 2,000 plasma spray units are in commercial use within the United States. These extreme temperature devices operate (with nitrogen) at over 12,000 degrees F. to spray materials which melt under 3,000 degrees F. Overheating is common with adverse alloying or excess oxidation processes occurring.

Recently, the HVOF (hypervelocity oxy-fuel) process has replaced many plasma applications for spraying heat-sensitive metals. Using pure oxygen as the oxidizer, flame temperatures of well over 4,000 degrees F. are realized. Thus, these devices also raise the powder particle to the melting point prior to impact against the workpiece surface. Adverse alloying mechanisms and oxidation still take place although at a lesser rate than for plasma torches.

In U.S. Pat. No. 5,129,582 for an HVAF (hypervelocity air-fuel) burner, it has been found that the quality of sprayed coatings of tungsten carbide powder with 13% cobalt is superior to HVOF-applied coatings of the same material. The improvement lies in the fact that the in-transit temperature of the powder particles is below the melting point. Additional heat to provide fusing of these particles is attributed to the conversion of kinetic energy to thermal upon impact against the workpiece surface.

SUMMARY OF THE INVENTION

This invention advantageously uses an internal burner capable of flame spraying nearly all the high melting point materials previously only sprayed using devices operating with oxygen contents greater than that contained in ordinary compressed air. Needless to say, large operating economics are realized where expensive pure oxygen is not required and simplicity and reliability of the operation are greatly enhanced by eliminating forced cooling water flow for such burners.

This invention is directed to a thermal spray method in which a fuel and an oxidant are continuously combusted at elevated pressure within a restricting volume of a combustion chamber (or by other thermal source) to produce a sonic or supersonic flow of hot gases from an extended nozzle to produce and direct a supersonic jet of the hot gases toward a workpiece surface to be coated. Powdered material is fed to the stream to be heated by the stream and projected at high velocity onto the workpiece surface. The improvement lies in feeding the powdered material into the extended nozzle, well down stream of the throat and after expansion of the hot gases thereby limiting the step of heating of the powdered material by the jet stream to that of raising the temperature of the particles to a temperature lower than the melting point of the material, maintaining the in-transit temperature of the particles to the workpiece below the melting point and providing sufficient velocity to the particles striking the workpiece to achieve an impact energy capable of releasing additional heat upon impact to fuse the material to the workpiece surface to form a dense coating thereon. The thermal spray method may utilize a plasma torch operating at high pressure to produce the hot jet stream issuing from the extended length nozzle bore or an internal burner. The powder or like particles may be preheated in a separate container from the source of the flame spray such as by inductive heating or a flame exterior of a ceramic container for the powder so long as the powder particles do not fuse, and with the flame temperature limited to prevent fusing of the powder particles prematurely in the ceramic container or other preheating support.

BRIEF DESCRIPTION OF THE DRAWINGS

The single figure is a longitudinal sectional view of the internal burner forming a preferred embodiment of the invention.

DESCRIPTION OF PREFERRED EMBODIMENTS

Figure 1:
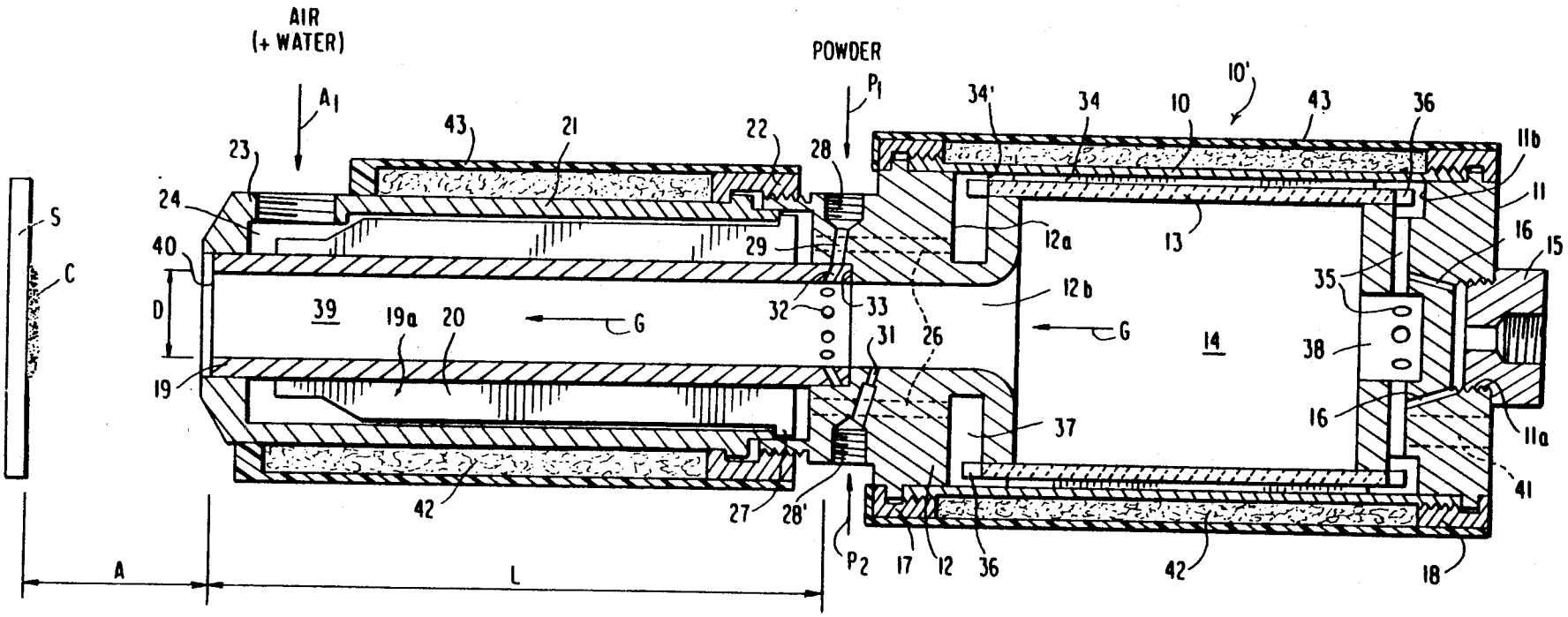

A better understanding of the invention may be obtained via the FIG. 1 cross-sectional view of a burner useful in practicing the method of this invention. In the figure flame spray burner 10' comprises an outer shell piece 10 to which the cylindrical flame stabilizer 11 and nozzle adaptor 12 are threadably connected by nuts 17 and 18.

Nozzle 19 pressure-seats against face 33 of adaptor 12 by means of nut 22 which presses outer cylindrical casing 21 against multiple shoulders 27 of multiple fins 20.

Compressed air, with or without mist cooling water passes through adaptor 23 to annular volume 24 defined by nozzle tube 19 and casing 21. The air then passes at high velocity through narrow slots **19*a* forming fins 20 to provide cooling of nozzle 19. From the slots the air passes through multiple longitudinal holes 26 in cylindrical adaptor 12 to annular volume 37 formed by a radial groove in adaptor 12 and thence through the narrow annular space 34' contained between shell 10 and combustor tube 13. The air, after cooling both adaptor 12 and combustor tube 13, passes radially through multiple circumferentially spaced radial holes 35 to stabilization well 38 formed by an axial bore in cylindrical stabilizer Il, while cooling stabilizer 11**.

Fuel for combustion enters stabilizer 11 through adaptor 15 threaded into a tapped axial bore **11*a* of stabilizer and thence through multiple oblique passages 16 into corresponding radial holes 35 to mix with the air passing to well 38 through holes 35. Ignition in combustion chamber volume 14 is effected by a spark plug (not shown) or by flashback from outlet 40 of nozzle passage or bore 39**.

Combustor tube 13, usually made of a refractory metal such as 310 stainless steel has thin circumferentially spaced ridges 34 projecting radially outwardly thereof to provide adequate radial spacing between tube 13 and shell 10. Tube 13 operates at a red heat, expanding and contracting as the burner is turned "on" and "off". It must be provided with adequate space to allow free expansion. Shoulders 36 at opposite ends of tube 13 are notched to prevent air flow cut-off in the event of tube axial expansion against adjacent faces **11*b*, 12*a* of elements 11 and 12. The combustion chamber 14 pressure is maintained between 50 psig and 150 psig when compressed air, alone, is the coolant. At greater pressures air cooling is not adequate. A small amount of water, as per arrow pre-mixed into the air $A_1$ prior to entry to adaptor 23** helps to film cool the heated elements of the burner. A quantity of water which does not lower the oxygen content by weight in the total air-water mixture to less than 12% can be used without need for pure oxygen addition. Such operation is adequate for spraying, as per arrow P, powders such as aluminum, zinc, and copper as even the lowered temperature is capable of adequate heating of such powder. For higher melting point powders such as stainless steel and tungsten carbide it is necessary to add pure oxygen to the air at A to provide the higher temperatures desired. At very high pressure the air-contained oxygen will not, in itself, support combustion as the water content will be too great. Thus, under such conditions pure oxygen must be added to keep the total percentage-by-weight of oxygen above 12% in the total mixture.

In some cases the increased cooling required may be met by increasing the inlet air flow $A_1$ substantially effecting better cooling of the structural elements. This added air is, later, discharged to the atmosphere prior to the point where fuel is injected. In FIG. 1, a dotted line longitudinal bore 41 within flame stabilizer 11 forms the discharge passage for this extra air flow. A valve therein (not shown) controls the discharge flow rate.

The high temperature products of combustion leave combustion chamber 14 and enter throat T of constricted area, downstream of inlet I, and expand to atmospheric pressure in their passage through nozzle bore 39. Powder is introduced well downstream of throat T, essentially radially into these expanding gases through either of two powder injector systems shown in FIG. 1. Where a forward angle of injection of the powder is desired (in the direction of gas flow), powder passes, as per the arrow P1 labeled "POWDER", from a supply tube (not shown) threadably attached to tapped hole 28 and thence through passage 29, open thereto, abutting the outer circumference of nozzle 19. One of the several oblique injector holes 32 is aligned with hole 29. A carrier gas, usually nitrogen, under pressure forces the powder into the central portion of the hot gas flow.

Where a rearward angle of injection of the powder is desired to increase particle dwell time in its passage through nozzle bore 39, a second injector system is utilized. From hole 28' the particles are forced by carrier gas flow, arrow $P_2$, through an oppositely oblique injector hole 31, into the hot gas exiting nozzle bore **12*b* of adaptor 12, sized to nozzle bore 39** and aligned therewith.

An advantage of the injection system using multiple injectors contained in replaceable nozzle 19 is that when one injector hole erodes by powder scouring to too large a diameter, a second hole 32 of correct size is alignable thereto, to accept powder flow from hole 29. Also, the injector holes 32 may provide different angles of injection as required to optimize the use of powders of different size distribution, density, and melting point. For example, for a given nozzle length "L", aluminum should have a much shorter dwell time in the hot gases than stainless steel. A sharp forward angle would be formed for aluminum in contrast to a closer-to-radial angle for stainless steel.

In the invention directed to spraying particles which are desired to be at or above the plastic state, any material being sprayed $P_1$, $P_2$ must be provided with an adequate dwell time to reach the plastic or molten state required to form a coating upon impact with a surface being spray-treated. As discussed in my U.S. Pat. No. 4,416,421, spraying of higher melting point materials using oxy-fuel flames requires L/D ratios for nozzle 19, bore 39 and that at **12*b* with adaptor 12**, greater than 5-to-1. The compressed air burners have been found to require about the same length nozzles as priorly used with pure oxygen units. As the air burner nozzles are, usually, about twice the diameter of their oxygen counterparts, the L/D ratio is reduced to 3-to-1.

The L/D ratio is determined by the effective length of the bore 39 from the point of introduction of the powder via a radial passage 32 into the nozzle 19 and its outlet or exit at 40, while the diameter D is the diameter of that bore. Such ratio is critical in ensuring that the particles are effectively molten or near molten at the moment of impact against the substrate S downstream from the exit 40 of nozzle bore 39.

Although the applicant has had a great deal of prior experience in the design of regeneratively-cooled compressed air internal burners, until recently the applicant did not appreciate that when used with extended nozzles, such internal burners would be adequate for spraying other than low melting metals in the form of wires or rods. In fact, the ability of such internal burners to spray tungsten carbide was discovered due to an error when the tungsten carbide was placed in the powder hopper in place of a lower melting point stainless steel.

Nozzle lengths with D/L ratios of over 15-to-1 were originally required to spray tungsten carbide powder successfully using the compressed air internal burner. By reducing the area of heat loss surface, increased flame temperatures were achieved. This achievement results mainly from increasing the combustor tube 13 diameter-to-length ratio. A classical calculus problem to determine the minimum wetted surface of a cylindrical container such as a can of food of given volume leads to the "tuna can" solution where the diameter is double the can's height. For a flame spray unit requiring, say, a combustion volume of 36 cubic inches, many choices involving diameter-to-length ratios exist. For example, the diameter may be 3 inches with a length just over 5 inches, or the "tuna can" solution of D=4.16 inches and L=2.08 inches. The latter diameter is too great as the copper pieces 11 and 12 are not routinely available in this large a diameter and the unit becomes awkward and heavy. The diameter-to-length ratio of 3-to-5 (that actually used) remains much smaller than previously used by the applicant in other applications of these devices not demanding maximum temperature attainment.

Even though the main loss of heat (that to a water coolant) has been eliminated by regenerative coolant flow of the combustion air, the outer surfaces of the burner reach high temperature during use and radiant heat loss of between 3% and 5% is estimated. Elimination of this loss by adequate thermal insulation means is necessary to reach maximum performance of the spray system. For this purpose, the outer surfaces of pieces or elements 10, 11, 12 and 21 are enclosed in a sheath of high-temperature thermal insulation material such as silica wool 42 covered by a sheet or coating 43. Nuts 17, 18, and 22 and other parts are also preferably coated with such temperature-resistant plastic as 43. It is believed that such thermal insulation of a flame spray internal burner is unique.

Example of a Flame Spray Burner of this Invention as Applied to Flame Spraying Molten Particles An example of a successful operating system is now provided using the burner 10; provided with 150 scfm of compressed air at 100 psig and propane at 60 psig to yield a combustor chamber 14 pressure of about 50 psig. Under stoichiometric conditions the gas temperature entering nozzle bore 39 from bore **12*b* adjacent to chamber 14 was about 3,200 degrees F. These hot gases expand to a lower temperature within the ¾-inch diameter combined nozzle bore 12*b*, 39 of 6-inch length until a Mach 1 flow region is attained. The temperature is, now, approximately 2,900 degrees F. for the remainder of the passage through the nozzle bore 39. For the 6-inch nozzle, successful spraying of both tungsten carbide and stainless steel powders $P_1$ were achieved. In fact, it appears that each coating C is at least as dense as when sprayed using the oxy-fuel counterpart. For the case of the stainless steel, nearly no oxides were visible in photomicrographs. There is much less overheating. The Mach 1 flow within the nozzle bore 39 is at a velocity of about 2,750 feet per second and expands beyond the nozzle exit 40** to M=1.65 (4,200 ft/sec). The sample substrates being sprayed was held a distance A=1 foot away from the burner allowing the particles to reach velocities greater than 2,000 ft/sec. This is comparable to those achieved using pure oxygen systems.

The condition of air and fuel pressure of the example are in the range of those oxy-fuel units currently in commercial use. Pressure increase to very high levels is a simple matter using compressed air and fuel oil in place of propane. For a combustion pressure of 1,200 psi with chamber 14, the fully expanded Mach No. is 4.5 (7,400 ft/sec). This leads to particle impact velocities on substrates of over 4,000 ft/sec, a value never achieved before. Coatings C have been found to improve in quality nearly directly proportional to impact velocity. Compressed air $A_1$ use above 500 psig therefore opens up a new area of technology in the flame spray field.

By choice of nozzle material and the amount of cooling provided by the compressed air $A_1$ (and mist) flow, it is possible to vary the inner nozzle surfaces of nozzles 19, **12*b* to a wide range of temperatures. Where coolest possible nozzle surfaces are desired—as nozzle 19 for spraying plastics, zinc, and aluminum from the nozzle bore 39, copper is the ideal material for forming the nozzle 19 bore 39 with maximum cooling provided. However, for high melting point materials such as stainless steel, tungsten carbide, the ceramics, and the like, it is desirable to maintain the inner nozzle 19 surface of bore 39 as at high a temperature possible. For this case, a refractory metal such as 316 stainless steel is used with either no cooling fins 20, or radially short end fins. Under these conditions, the inner nozzle bore 39 surface runs bright red at very high temperature. Heat losses from the hot product of combustion gas G are greatly reduced, thus maintaining a higher gas temperature throughout the nozzle length L. Also, radiation cooling of the heated particles is reduced substantially. Such use can allow the effective nozzle length to be cut in half and nozzle 19** is capable of spraying higher melting point materials than highly cooled copper nozzles.

Examples of a Flame Spray Burner of this Invention to a Method of Flame Soravino Non-Molten Particles Prior to Impact on a Workpiece Five examples are given to show the effects upon in-transit particle temperature via the apparatus of the single figure in this application, as is or as modified as described hereinafter, as functions of combustion temperatures and particle impact velocity. In these examples:

Po=combustion chamber pressure
P=atmospheric pressure
K=ratio of specific heats of the gas
M=Mach number
Vj=jet velocity
Vp=particle velocity
Δh=enthalpy released on particle impact
To=combustion temperature
T=expanded gas jet temperature
a=sonic velocity at jet temperature Tp=particle temperature after impact
g=gravity constant EXAMPLE I—Current HVOF practice (See my U.S. Pat. No. 4,416,421)
Po=100 psig=115 psia
P=0 psig=15 psia
To=4,600 degree Fahrenheit using fuel oil with pure oxygen
K=1.2 (assumed)
From, "Gas Tables", Keenan, H. H. and Kaye, J. John Wiley & Sons, Inc., 1948,
for a value of P/Po=0.71, the expanded jet temperature (T) is 3,130 degree Fahrenheit. The Mach No. (M) is 2.0.
For 3,130 degree Fahrenheit, a=2,800 ft/sec. Vj=Ma=5,600 ft/sec. A particle velocity of 2,500 ft/sec is assumed which agrees well with experimental laser Doppler measurements of HVOF spray streams. (In the HVOF process, where particle melting can occur, nozzle lengths are rather short compared to HVAF nozzles due to "plugging" of longer nozzle lengths by molten particles. Thus, the higher particle velocities available using longer nozzles are not achieved.)

The jet temperature of 3,130 degree Fahrenheit is significantly greater than the melting point of about 2,700 degree Fahrenheit for ferrous metals and cobalt (used with tungsten carbide). The particles (assumed to reach jet temperature) become plastic or molten in-transit to the workpiece. Adverse alloying processes may occur as well as oxidation.

The jet gases, in the absence of entrained powder, reach a temperature of 3,130 degree Fahrenheit. Assume a melting point of 2,700 degree Fahrenheit and a specific heat of 0.1 for the metal powder being sprayed. Also, assume that the powder temperature is equal to the jet gas temperature as impact against the workpiece. When the particles upon impact reach 2,700 degree Fahrenheit the latent heat of fusion must be provided before a further temperature increase results. The enthalpy available per pound of gas is Cp T=0.29 (3130-2700)=125 btu/lb. There are, usually, about 20 pounds of reactants per pound of powder sprayed. Thus, ignoring the latent heat requirement does not introduce a significant error when assuming that the powder reaches jet gas temperatures.

Upon impact with the workpiece, a sudden increase in enthalpy occurs. This rise may be calculated from $$\Delta h = \frac{V^2}{2gJ}$$

where g is the gravitational constant and J-778 ft-lb/btu. for this example, the particles are molten prior to impact. The 125 btu/lb available upon impact causes a further "detrimental" temperature rise of 1250 degree Fahrenheit. The maximum particle temperature is 3,560 degree Fahrenheit.

EXAMPLE II—Using the air burner of U.S. Pat. No. 5,120,582

To=3,500 degree Fahrenheit
Po=70 psig=85 psia
P=0 psig=15 psia
K=1.2 (assumed)
Then from Keenan & Kaye
M=1.84
T=2,625 degree Fahrenheit
and,
a=2600 ft/sec.
Vj=4,780 ft/sec.

Assuming in each of these examples that the particle is heated to jet temperature, the particle temperature of 2,625 degree Fahrenheit is below the melting points of ferrous metals and cobalt. The material in-transit is solid with few, if any, adverse alloying or oxidation reactions taking place. (Tungsten carbide particles are not melted even after impact.) Even though the jet velocity is lower than in Example I, the use of a much longer nozzle makes an assumed particle velocity of 2,500 ft/sec reasonable. This value yields an enthalpy increase upon impact of 125 btu. Of this, for steel or cobalt, a latent heat of fusion of about 117 btu/lb must be provided prior to further particle temperature increase. After fusion, 8 btu/lb are available to yield a further 80 degree Fahrenheit temperature rise. The final maximum particle temperature reaches 2,780 degree Fahrenheit. Compare this to the 3,560 degree Fahrenheit of Example I.

Certain advantages occur with this aspect of the invention. As the particles are not fused prior to impact, much longer nozzles may be used to achieve peak impact velocities. "Plugging" can no longer occur. The greater the impact velocity, the denser the coating becomes. Lack of adverse alloying and oxidation lead to high-quality coatings.

EXAMPLE III—Air burner at high pressure

To=3,500 degree F.
Po=600 psig
P=0 psig
K=1.2 (assumed)
Then, from Keenan & Kaye,
M=2.9
Tj=1,890 degree F.
a=2,300 ft/sec
Vj=6,670 ft/sec
assume Vp=3,000 ft/sec
Δh=180 btu with 63 btu/lb of metal available for further temperature increase of 630 degree F.
Final maximum particle temperature is 3,330 degree F.

The many assumptions and simplification used in these calculations lead to possibly great errors. First, the particles with short dwell time in the hot gases never reach gas temperature. Therefore, all particle temperatures of the examples above are greater than actual. The true ratio of specific heats, K, is not known. Using 1.1 or 1.3 in place of the 1.2 used here yields very different results. The inventor is not prepared to challenge in detail one versed in the theories presented here. Rather, comparison of the examples show that in-transit particle temperatures can be held below the melting point and that impact energies are sufficient to provide necessary fusion to produce excellent coatings. And, this fact has been proven in actual use.

Another assumption made disregards heat losses from the gases passing through long nozzles. Even a 10% loss would seriously affect the calculation. Thus, nozzles more than 2 feet long may become impractical. When using long nozzles with high melting point powders, added oxygen to raise the combustion temperature (To) becomes necessary.

EXAMPLE IV—Pure oxygen burner at 2,400 psig.

To=4,500 degree F.
Po=2,400 psig $$P/Po = \frac{15}{2415} = 0.0062$$

T/To=0.4
M=3.7
T=1,524
Assume V=4,000 ft/sec
Δh=320 btu/lb which will increase the stream temperature by 1103 degree F.
$T_{max}$=2,627 degree F.

This is not sufficiently hot to lead to fusion of the particles. A higher temperature system—plasma—would have to be used. Thus, the principles of the invention apply to air-fuel and oxy-fuel burners as well as plasma torches.

Another source of error in the calculations concerns the impacting particle. During impact, heat is transferred from the hot particle to the workpiece, or to the coating already formed on the surface. Heat transferred to the workpiece by an impacting particle may be substantial. Where heat transfer times are measured in micro-seconds for very high velocity impacts, such rapid heating, together with low conductive heat flow into the workpiece, can raise the workpiece (at the point of impact) to a temperature allowing metallurgical bonding between the workpiece and the coating.

In essence, the invention covers a process whereby particles being sprayed by introducing a powder to a hot supersonic stream are kept below their melting point until striking the workpiece surface. Fusion results only upon impact. To now, only materials with melting points around 2,700 degree F. have been discussed. For lower melting point materials such as aluminum, zinc, and copper the processes of the invention are met simply by lowering the combustion temperature (To). This is accomplished reducing the fuel content to well below stoichiometric. A simple way to set the reduced fuel flow is to measure the spray plume temperature by pyrometric means. The heated particles spray plumes for zinc, aluminum, and copper are not visible to the naked eye. Stainless steel plumes are a faint yellow. For materials of much higher melting point than 2,700 degree F. the use of pure oxygen may be necessary, or (by the principles of my U.S. Pat. No. 4,370,538) a first jet of high temperature gases heats the powder to near the melting point. A second high velocity flame of lower temperature accelerates the particles to a speed which, upon impact, yields sufficient fusion to produce the coating.

For very high melting point materials, for example, the ceramics, plasma torches may be substituted for combustion devices such as that shown in the drawing. In this method, the 12,000 degree F. jet of conventional plasma torches is reduced to that necessary to raise the particles to near, but below, their melting point with the remainder of the heat energy converted to increase jet velocity. Conventional plasma equipment operates at relatively low voltage (about 70=v for nitrogen). Short nozzles are required and the issuing jet is sub-sonic. By increasing the voltage (for the same power output) much longer nozzles are necessary. Using high gas pressures at the inlet to a long nozzle, extremely high exit velocities are realized. A plasma torch operating at 200 psig can produce a jet velocity of over 12,000 ft/sec with an exit temperature of about 7,500 degree F.

EXAMPLE V—Plasma spraying of aluminum oxide at 200 psig

To=6,000 degree F.
Po=215 psia
Po/P=0.070
To/T=0.58
M=2.65
T=3,286 degree F.

With a melting point of about 3,400 degree F.
a=2850 ft/sec
Vj=7,550 ft/sec
assume V=3,500 ft/sec Δh=245 btu/lb $Al_2O_3$ with ΔT=845 degree F., Tmax=4,131 degree F. which is sufficient to produce a coating of the aluminum oxide.

While, the invention discussed herein may be practiced by a flame spray burner as shown in the drawing and described in detail in the specification, it should be appreciated that the particles may be preheated prior to introduction into the high velocity stream for delivery and impact against the surface of the workpiece or substrate to be coated. For instance, the powder or other particles may be preheated in a separate container, for instance inductively, or by a separate flame impinging upon a ceramic container bearing the particles so long as the particles do not fuse together. The flame should be hot enough to preheat the particles below the plastic or molten state.

The applicant has also determined that the method as claimed hereinafter is effectively and efficiently practiced by the apparatus as shown in the drawing permitting an extended length nozzle of 12 inches to be reduced to a 6 inches nozzle by turning the rate of fuel flow down leading to the burner by reducing the fuel pressure from 70 psig as an example to 50 psig.

In practicing the method of the present invention, various operating parameters involved in the multiple steps recited within the claims permit a great flexibility in practicing of the method.

The applicant has noted that using a stoichiometric combustion in prior practice in accordance with U.S. Pat. No. 5,120,582, the nozzle length if in excess of 6 inches, the particles would melt prior to exit from the nozzle bore and coat the nozzle bore. However, in conjunction with the claimed improvement by significantly reducing the fuel flow with a given flow of compressed air, the nozzle length for such internal burner could be of length up to 12 inches resulting in improved coating with no melting prior to impact. Microphotographs of the coating show the oxide content to be greatly reduced, with a highly improved bond interface between the coating and the workpiece. A reduction in air pressure from 70 psi to 50 psi with appropriate reduction in fuel gave the positive results described above.

It should be understood that modifications and variations in the process parameters of this invention may be made without departing from the spirit and scope of the invention, which is limited only in accordance with the following appended claims.

What is claimed is:

1. In a thermal spray method comprising the steps of: continuously combusting a fuel and oxidant under pressure within a restricting volume of a combustion chamber and expanding the products o combustion of said fuel and oxidant as gas into an extended nozzle having a throat opening to said combustion chamber and producing at least a sonic flow stream of gases from an said extended nozzle to produce and direct a supersonic jet of said gases toward a workpiece surface to be coated;

feeding a powdered material to said stream to be heated b said stream and projected onto the workpiece surface;

the improvement wherein the step of feeding said powdered material comprises feeding said powdered material into said extended nozzle at a point downstream from said throat and after expansion of the gases to a temperature which limits the heating of said powdered material to that which raises the temperature of particles of said powdered material to that lower than the melting point of said powdered material, and wherein said method further comprises maintaining an in-transit temperature of said particles from said feeding point to said workpiece below said melting point, and providing a sufficient velocity to said particles such that impact energy caused by said particles striking said workpiece is transformed into heat, thereby increasing the temperature of the particles to the fusion temperature of the particles, thereby fusing the powdered material to form a dense coating on the workpiece surface.

2. The method of claim 1, wherein the step of feeding said powdered material to said stream comprises feeding said powder into the stream at a point along the stream where an expansion of said gases has reduced the temperature of said stream to less than the temperature of the melting point of said material being sprayed.

3. The method of claim 1, wherein the oxidant is air.

4. The method of claim 1, wherein the oxidant is a mixture of air and pure oxygen.

5. The method of claim 1, wherein the oxidant is pure oxygen.

6. The method of claim 1, wherein the fuel and oxidant are combusted at combustion pressures such that the temperature of solid particles of the powdered material striking said workpiece is minimized to achieve impact energy values sufficient to cause fusion of the particles to form a coating.

7. The method of claim 6, wherein combustion is effected at a pressure greater than 250 psig.

8. The method of claim 6, wherein combustion is effected at a pressure greater than 500 psig.

9. The method of clam 6, wherein combustion is effected at a pressure greater than 1,000 psig.

10. The method of claim 1, wherein the heating of said powder particles to below the melting point thereof is effected by using a first temperature jet and said method further comprises accelerating the heated solid particles toward the workpiece using a second jet.

11. The method of claim 1, wherein the powder to be sprayed is a mixture of at least two materials of different melting points, and where, upon impact, the material of lower melting point is fused, while the material of higher melting point remains in the solid state throughout the method.

12. The method of claim 1, wherein the powder to be sprayed is a mixture of tungsten carbide and cobalt and where only cobalt is fused upon impact.

* * * * *